US007717391B2

(12) United States Patent
Roberts

(10) Patent No.: US 7,717,391 B2
(45) Date of Patent: May 18, 2010

(54) PORTABLE CLOTHES STAND

(76) Inventor: Patricia Alida Roberts, 9 Auburn Avenue, Myrtle Bank (AU) 5064

( * ) Notice: Subject to any disclaimer, the term of this patent is extended or adjusted under 35 U.S.C. 154(b) by 86 days.

(21) Appl. No.: 10/592,327

(22) PCT Filed: Mar. 11, 2005

(86) PCT No.: PCT/AU2005/000341

§ 371 (c)(1),
(2), (4) Date: Jun. 6, 2007

(87) PCT Pub. No.: WO2005/088002

PCT Pub. Date: Sep. 22, 2005

(65) Prior Publication Data

US 2008/0035593 A1 Feb. 14, 2008

(30) Foreign Application Priority Data

Mar. 11, 2004 (AU) ..... 2004901243

(51) Int. Cl.
*A47F 5/00* (2006.01)

(52) U.S. Cl. ..... 248/353

(58) Field of Classification Search ..... 248/166, 248/436, 439, 440; 211/119.01
See application file for complete search history.

(56) References Cited

U.S. PATENT DOCUMENTS

2006/0226311 A1* 10/2006 Radermacher ..... 248/166

FOREIGN PATENT DOCUMENTS

| | | | |
|---|---|---|---|
| AU | 42081/96 | * | 1/1996 |
| AU | B-42081/96 | * | 1/1996 |
| AU | B-42081/96 | | 8/1996 |
| DE | EP 0 882 834 A1 | * | 12/2001 |
| FR | 2 244 039 | | 4/1975 |
| GB | 2 020 169 A | | 11/1979 |

OTHER PUBLICATIONS

International Search Report for PCT/AU2005/000341 dated Apr. 13, 2005 (2 pages).

* cited by examiner

*Primary Examiner*—J. Allen Shriver, II
*Assistant Examiner*—Erin Smith
(74) *Attorney, Agent, or Firm*—Osha • Liang LLP

(57) ABSTRACT

A clothes line with a central frame member (8). Outwardly extending end members (4) and (6) supporting clothes line therebetween, and legs (10) and (12) at each end of the member (8) which are supported to be foldable, between a position where they lie alongside the member (8) to a position providing support for the member (8). And there are means between the legs (10) and (12) and the member (8) which provides a locking strut effect.

11 Claims, 6 Drawing Sheets

PORTABLE CLOTHES STAND

TECHNICAL FIELD

The present invention relates to portable clotheslines.

The term "portable clothes line" is to used to identify clothes lines which are able to be folded into a compact storage shape and when they are to be used are able to be extended with a body including a plurality of parallel "lines" from which clothes and other washed articles can be attached and hung for drying. We are referring to such an article in this document which article includes a body which includes the line or lines from which clothes or the like can be hung, and legs that can be extended when the stand is required to be in a usable state, and subsequently retracted for storage purposes and to facilitate portability.

BACKGROUND ART

There have been various arrangements to facilitate the easy and efficient locking of such legs in an extended position and also to facilitate the release and lowering of such legs to a compact state. Hitherto one arrangement has included a set of hinged members which lock using an overcenter interlocking arrangement which has been found to be quite difficult for some people to use especially those who may be more elderly or frail. At the same time, the cost of manufacture with many individual parts has been also of concern especially for the area of the market that such a product is directed to.

It is an object of the present invention to provide a portable clothes-drying stand that overcomes or at least substantially ameliorates the problems associated with the portable stands of the prior art.

Other objects and advantages of the present invention will become apparent from the following description, taken in connection with the accompanying drawings, wherein, by way of illustration and example, an embodiment of the present invention is disclosed.

DISCLOSURE OF THE INVENTION

In one form of this invention there is proposed a portable clothes line including a body, and at least one leg pivotally attached to the body at each end of the body, and releasable locking means that for each end extend between the body and a respective leg or legs, the means being pivotally attached at one end to at least a one of the legs and at a further end in releasable manner to the body.

Preferably, the body includes a pair of outwardly extending oppositely positioned arms with a line or lines extending therebetween, and a central frame member supporting the opposing end members.

Preferably, there is at each end a pair of legs with each of the legs of a pair being fixedly joined to the other leg and having each leg with a foot that is separated from the other foot of its paired leg so as to provide support for the line.

Preferably, the selectively releasable locking means include a link arm for each pair of legs which at its upper inner end is connected to a slidable bracket which is slidably engaging a central frame member.

Preferably, each selectively releasable locking means includes a stop fixedly secured to the central frame member, the slidable carriage or bracket being slidably free to travel along the central frame member, wherein in use, extension of the legs draws the carriage into selectively releasable locking engagement with the stop thereby locking the legs in an extended position.

Preferably the link arm is a single element which is pivotally attached at its upper end to the respective slidable bracket and at its lower end to each respective one of the pair of legs.

Preferably, the carriage has an inner hollow bore that is sized and shaped so as to be a sliding fit around the central frame member.

Preferably, the stop is positioned between the carriage and the pivot point at a respective end of the central frame member for any given pair of legs.

In a further form, the invention may be said to lie in a portable clothes drying stand that includes a body, and at least one leg pivotally attached to the body, wherein in use, when a leg is allowed to move into either of an extended or retracted positions the stand includes selectively releasable locking means that are adapted to lock the leg in either of its fully extended or retracted positions.

Preferably, one selectively releasable locking means can lock both legs in a retracted position.

In a further form, the invention may be said to reside in a portable clothes line which includes a body, the body having a central frame member, outwardly extending oppositely positioned arms providing support for a line or lines extending between the respective arms being located at and secured to each respective end of the central frame member, and with, at each end, a leg or legs which is or are secured to the central frame member and at or toward a respective end of the central frame member so that each can assume either of two positions, a first position being a supporting position in which the respective leg or legs is or are extended to provide support for the body above a surface, and a second position being a storage position in which the respective leg or legs are folded so as to lie alongside the central frame member, and for each leg or pair of legs at respective ends there is a link which extends between the leg or legs at a respective end of the central frame member and the central frame member itself where the link arm is pivotally supported and secured at one end to the leg or legs and at a further end is positioned and shaped so that it is restrained to slide only along the central frame member, and there are means to releasably interengage the said further end with respect to the central frame member to thereby maintain an extended position of the said respective leg or pairs of legs.

Preferably, there are two legs at each respective end of the member.

Preferably, the further member includes a bracket or carriage that is retained to be slidable along the member and there is an arm pivotally secured to the bracket with the further end being pivotally secured to the leg or legs.

In a further form the invention can be said to reside in a portable clothes line with a body including a pair of oppositely positioned end members, and a central frame member as a body which is a continuous length of tube of constant cross sectional shape and size along its length supporting the oppositely positioned end members, lengths of clothesline in parallel alignment extend between the oppositely positioned end members and are threaded from a length of pliable line in a manner that provides for a plurality lines on each of both sides of the respective oppositely positioned end members, a pair of tubular aluminum legs, pivotally attached to the body at an upper end of each of the legs, the respective pairs being joined together by for each a cross-member which is secured fixedly so as to ensure the pair of legs extend and retract together, a stop fixed to the central frame member, a carriage that is positioned and shaped to travel along the central frame member, the carriage including an integral collar with an internal bore that is sized and shaped so as to be a free sliding fit when moving along the central frame member, a stop positioned between the carriage and the pivot point for each pair of legs, the carriage having a link arm attached to it, that connects it to a respective pair of legs, such that in use, extension of the legs draws the carriage into selectively releasable locking engagement with the stop, thereby locking the legs in an extended position.

BRIEF DESCRIPTION OF THE DRAWINGS

For a better understanding of this invention it will now be described with respect to the preferred embodiment which shall be described herein with the assistance of drawings wherein.

BEST MODE FOR CARRYING OUT THE INVENTION

Figure 1:
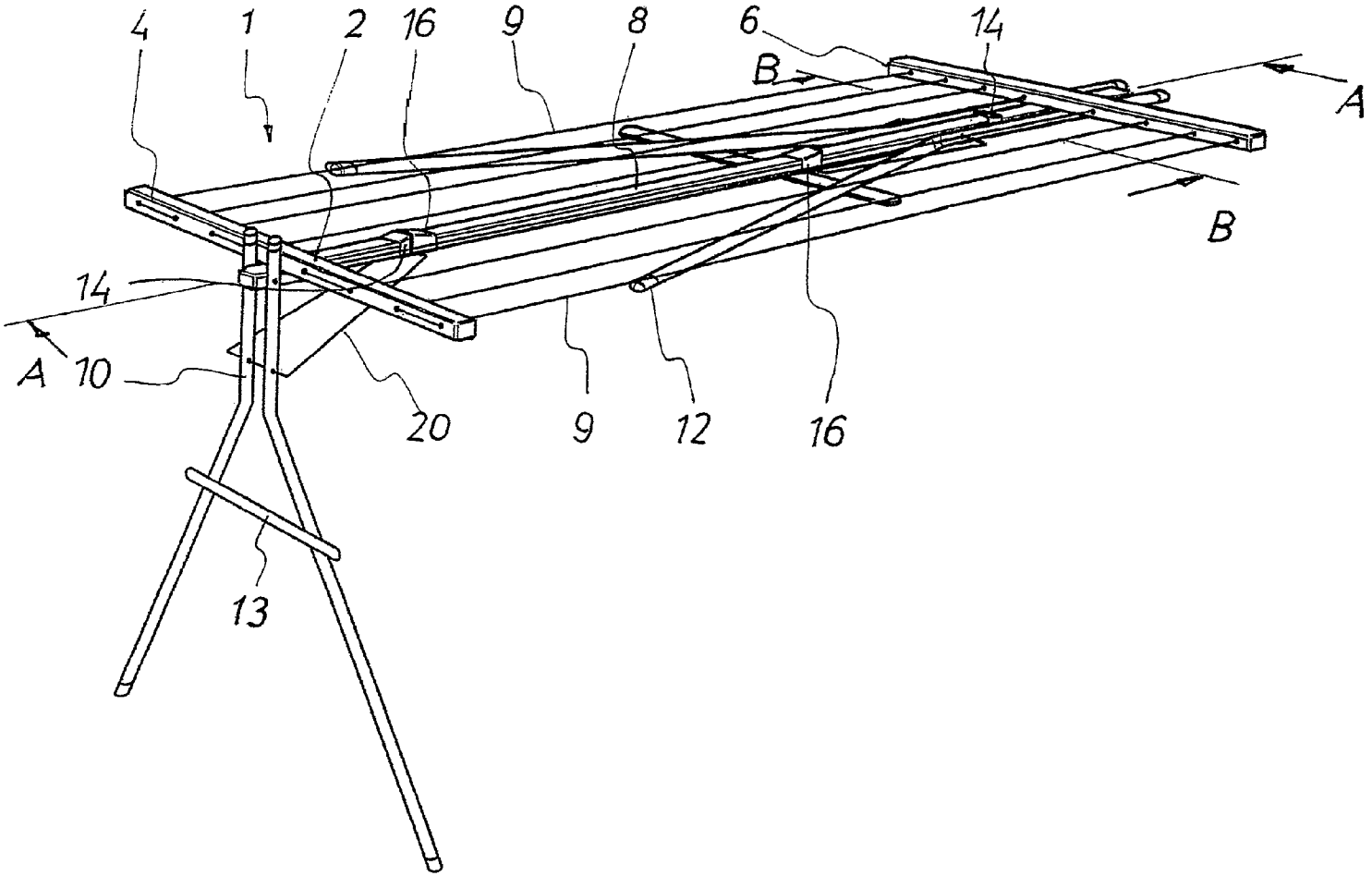
FIGS. 1 and 2 are perspective views of the portable clothes line according to the preferred embodiment of the present invention.
Figure 2:
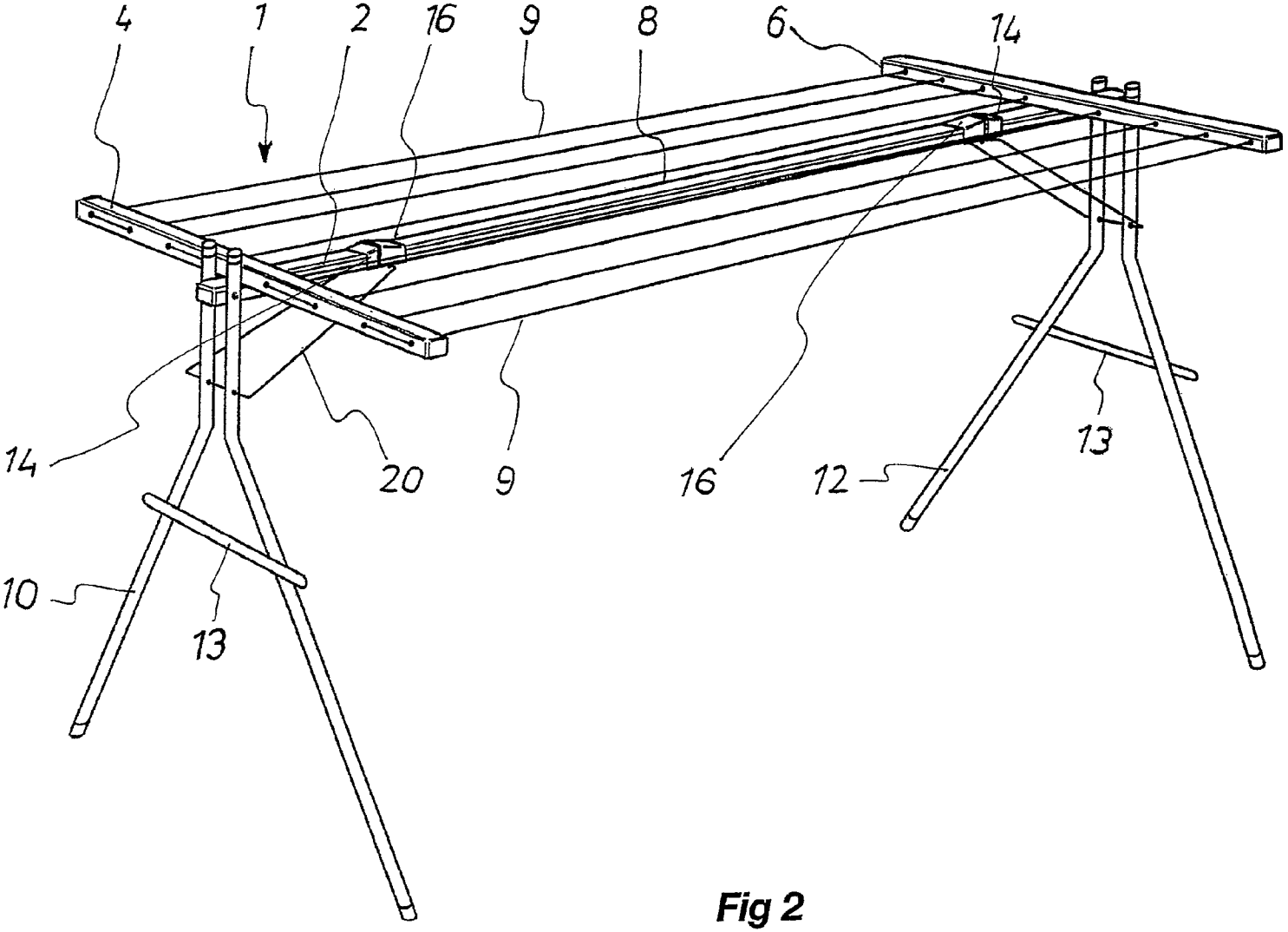
Figure 3:
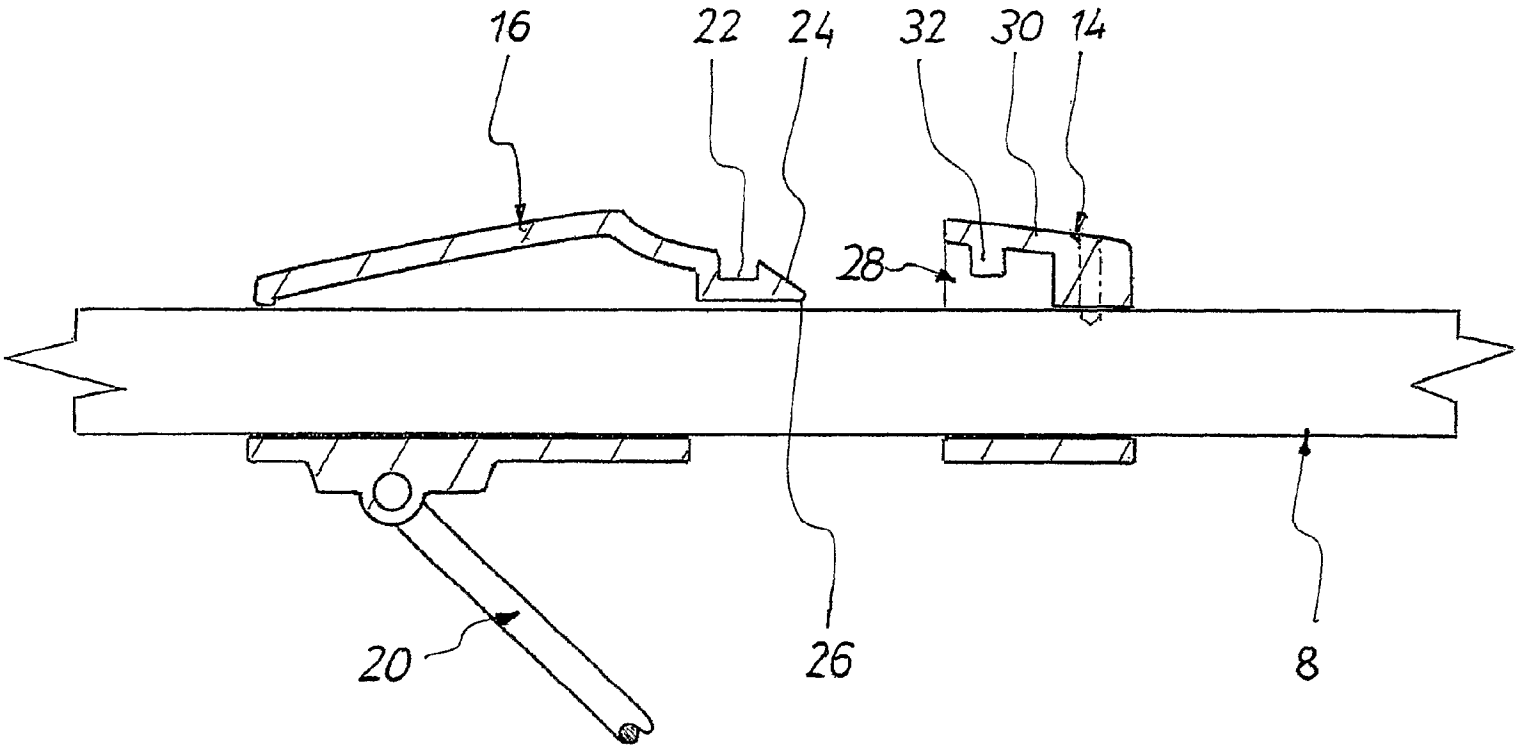
FIGS. 3 and 4 are cross-sectional views through the carriage and stop of the portable clothesline in FIG. 1 along line A-A.
Figure 4:
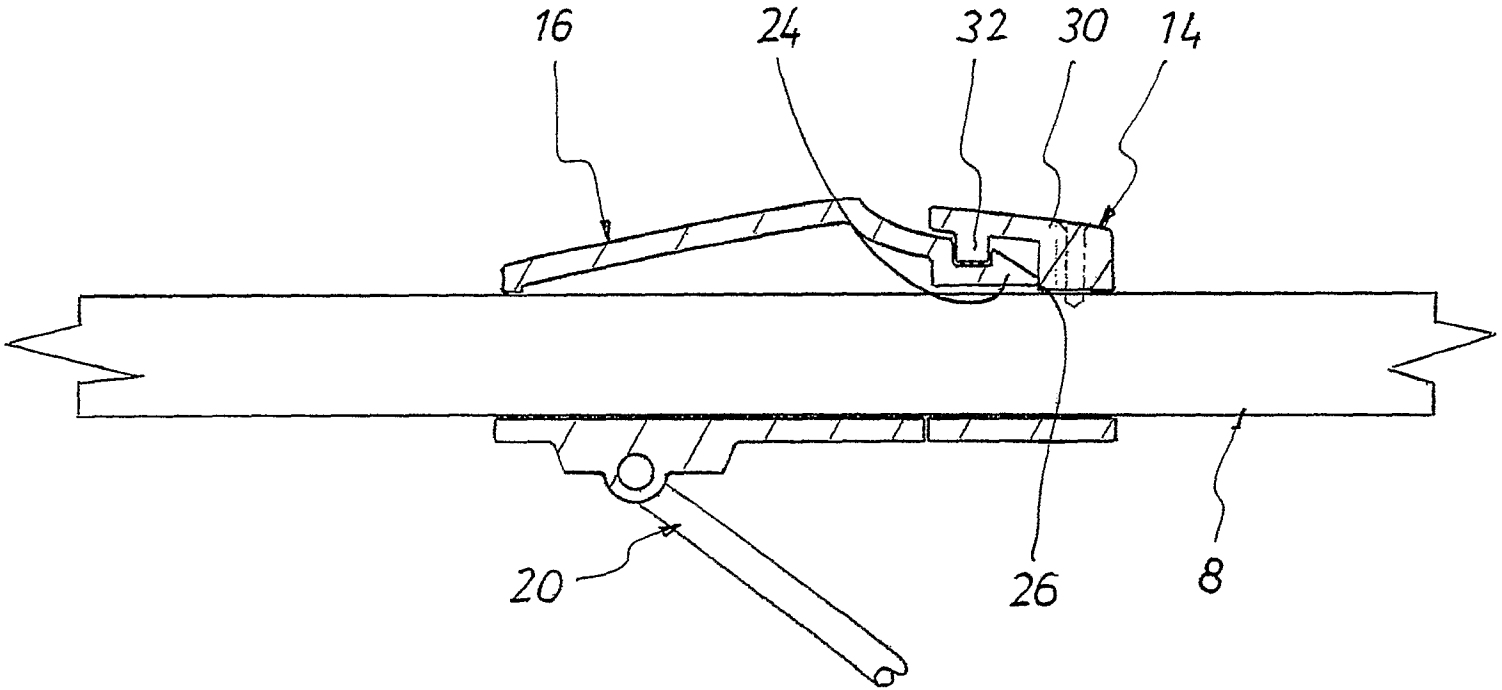
Figure 5:
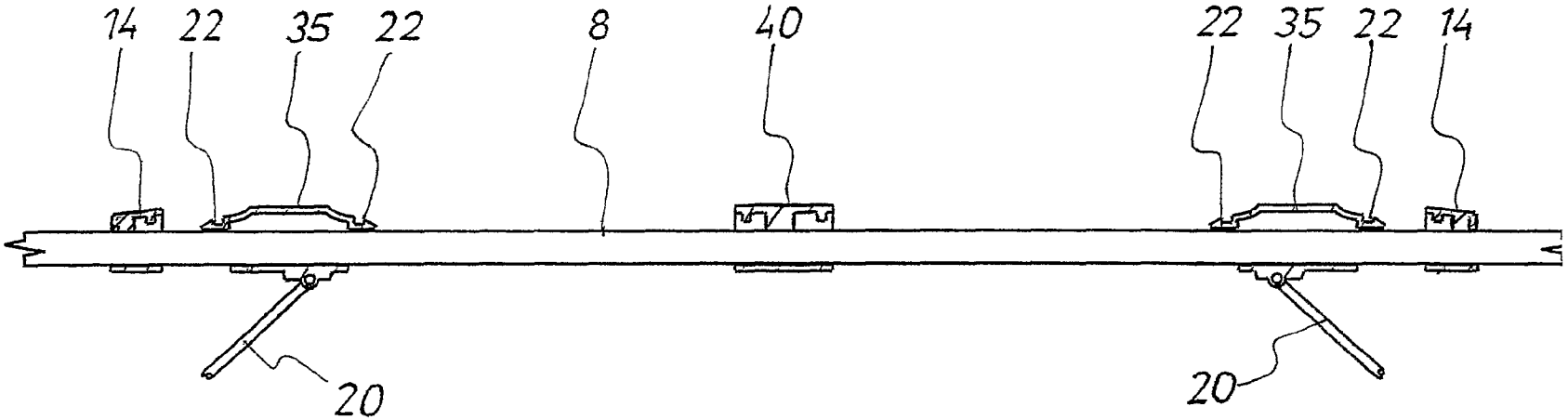
FIG. 5 is a cross-sectional view through the carriages and a stop of a portable clothes-drying stand according to a further embodiment.

Now referring to the illustrations, and in particular to FIG. 1, there is a portable clothes line 1, with a body 2 including a pair of oppositely positioned end members 4 and 6, and a central frame member 8 which is a continuous length of square cross section tube of constant cross sectional shape and size along its length and is used so that it is supporting the opposing end members 4 and 6. The opposing end members 4 and 6, and the central frame member 8 are of square hollow tubular aluminum of the same shape and size throughout its length. Lengths of clothesline 9 in parallel alignment extend between the opposing end members 4 and 6 and are threaded from a continuous length of pliable line in a manner that provides for a plurality (in this case 4) lines on each side.

The stand 1 includes a pair tubular aluminum of legs 10 and 12, pivotally attached to the body 2 at an upper end thereof, the respective pairs being joined together by cross-members 13 which are secured fixedly so as to ensure that they extend and retract together. Each leg comprises a first portion that extends straight down, and a second portion that extends both downwardly and outwardly to an outwardly located foot so as establish thereby adequate stability of the erected stand.

There is a stop 14 fixed via a screw to the central frame member 8, and a carriage 16 that is free to travel along the central frame member 8. The central frame member 8 is a tubular aluminum member of square cross-section, this cross-section being consistent in shape and size along the entire length of the frame member 8. The carriage then is an integral collar with an internal bore that is sized and shaped so as to be a free sliding fit on the central frame member with minimal slop or play.

Both the carriages 6 and the stop are made from a plastics material. The stop is positioned between the carriage and the pivot point for any each pair of legs. The carriage 16 has a link arm 20 attached to it, that connects it to a pair of legs, such that in use, extension of the legs draws the carriage 16 into selectively releasable locking engagement with the stop 14, thereby locking the legs in an extended position. The link arm 20 is a single piece of wire bent into a U-shape, the link arm 20 having in-turned ends at a first end that are adapted to engage the legs of the stand by being inserted into an aperture in a side of a respective leg. At its second end, the link arm 20 passes through an aperture in the underside of the carriage 16.

The carriage 16 has a tab 22 integrally formed with it; this tab extends from the body of the carriage such that it is cantilevered from it. The tab 22 has an upwardly extending, ramped head portion 24, which is thinnest at the leading edge 26 of the tab 22.

The stop 14 has an opening 28 that is adapted to accept the head portion 24 of the tab 22, and includes a top wall 30 that has a lip 32 extending downwardly from it. In use then, extension of the legs draws the carriage 16 toward the stop 14 until the head portion 24 of the tab 22 comes into contact with the downwardly extending lip 32 in the stop. This lip gradually forces the head portion 24 of the tab 22 downwardly until the ramped portion of the head 24 has passed under the lip 32, at this point the resiliency of the plastic material from which the carriage 16 and its integrally formed tab 22 are formed allows the tab to spring upwardly, so that the stop captures the carriage, and prevents it from being removed in normal use. If a user wishes to remove the carriage from the stop, they press down on the tab at a point proximate to the head, so that the head can again pass under the lip 32, thereby allowing the legs of the stand 1 to be retracted.

Figure 6:
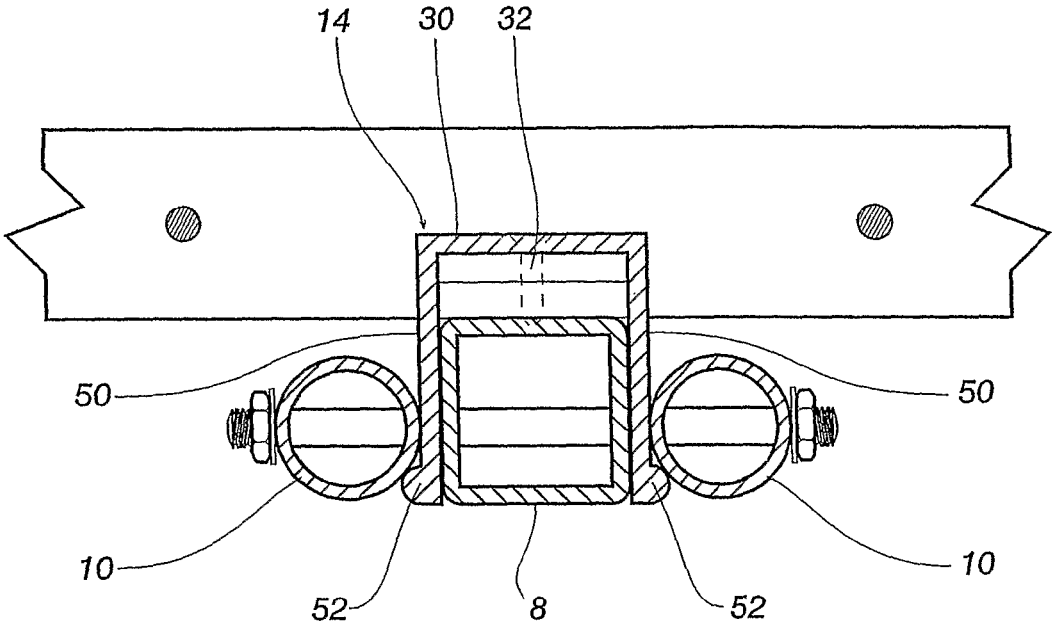
FIG. 6 is a cross-sectional view through the frame and stop of the portable clothes in FIG. 1 along line B-B.

Referring now to FIG. 6, the stop 14 includes a pair of legs 50 that are integrally formed with, and extending downwardly from the top wall 30 of the stop 14. At their lowermost edge the legs 50 include integrally formed, outwardly projecting bulbous portions 52 that are adapted to capture the straight portions of the stand's legs when they are in the retracted position.

In a further form each carriage 35 might include tabs 22 at both ends, so that the carriages can also be used to lock each set of legs in a retracted position, using a double sided, centrally positioned stop 40.

The arrangement described simplifies the arrangement that has hitherto been used and is found to enable less able people to be also able to erect and collapse the stand without great difficulty.

Significant advantages of the clothesline according to the present invention therefore are that the legs will automatically lock into position if they are allowed to drop into their erected position, making erection of the stand easy for one person. Once locked into position, the legs are securely locked in this extended position, so that if the clothes line is unintentionally bumped, it will not collapse.

It is considered therefore that a portable clothes-drying stand such as that described herein would prove to be of considerable benefit to those who desire a portable clothes-drying stand that can be erected and put away quickly and easily, and which is sturdy when erected.

Although the invention has been herein shown and described in what is conceived to be the most practical and preferred embodiment, it is recognised that departures can be made within the scope of the invention, which is not to be limited to the details described herein, but is to embrace any and all equivalent devices and apparatus.

The invention claimed is:

1. A portable clothes line comprising:

a body having a central elongate frame member;

an arm disposed at each end of the central elongate frame member, wherein each arm is arranged so as to extend outwardly from the central elongate frame member;

at least one line extending between the arms;

at least one leg pivotally attached to each end of the central elongate frame member; and releasable locking means attached to each of the legs, wherein each of the releasable locking means extends from the leg to the central elongate frame member, wherein each of the releasable locking means comprises:

a first end pivotally attached to the leg, and a second end slidably and pivotally attached to the central elongate frame member, and wherein the slidable and pivotal engagement of the releasable locking means facilitates a locking or releasing of the leg with respect to the central elongate frame member.

2. A portable clothes line as in claim 1, wherein each releasable locking means comprises:

a link arm pivotally connected at an upper end to a slidable carriage or bracket, which is slidably retained with respect to the central elongate frame member of the body, and pivotally connected at a lower end to the leg.

3. A portable clothes line as in claim 2, wherein the releasable locking means comprises a stop fixedly secured to the central elongate frame member, wherein the slidable carriage or bracket is adapted to slidably engage with or freely travel along the central elongate frame member, wherein, in use, extension of the legs draws the slidable carriage or bracket into releasable locking engagement with the stop thereby locking the legs in an extended position with respect to the central elongate frame member.

4. A portable clothes line as in claim 3 further characterized in that wherein the link arm is a single element.

5. A portable clothes line as in claim 4 wherein the slidable carriage or bracket has an inner hollow bore that is sized and shaped so as to be a sliding fit around the central elongate frame member.

6. A portable clothes line as in claim 5, wherein the stop is positioned between the slidable carriage or bracket and the pivot point of each leg at a respective end of the central elongate frame member.

7. A portable clothes drying stand comprising:

a body having a central elongate frame member;

at least one leg pivotally attached to each end of the central elongate frame member; and at least one releasable locking means pivotally attached to the at least one leg and slidably and pivotally attached to the central elongate frame member, wherein, in use, when the at least one leg is allowed to move into either of an extended or retracted positions relative to the central elongate frame member the at least one releasable locking means is adapted to lock the at least one leg in either of fully extended position in a first case and fully retracted position in a second case.

8. A portable clothes drying stand as in claim 7, wherein one releasable locking means can lock both legs in the retracted position.

9. A portable clothes line comprising:

a body comprising:

a central elongate frame member, and at least two outwardly extending oppositely positioned arms providing support for a plurality of lines extending between the arms, the plurality of lines located at spaced apart locations along each arm;

at least one leg pivotally attached to the central elongate frame member at each end thereof and configured to assume either of two positions, a first position being a supporting position in which the legs are extended to provide support for the body above a support surface, and a second position being a storage position in which the legs are folded so as to lie generally alongside the central frame member; and a link arm extending between each leg and the central elongate frame member, wherein each link arm is pivotally supported and secured at a first end to the leg and at a second end is pivotally attached to releasable locking means, the releasable locking means positioned and shaped to slidably engage along the central elongate frame member, and the releasable locking means configured to releasably interengage with the central frame member such that it is releasably securable in a relative position with respect to the central elongate frame member in which the legs are in an extended position.

10. A portable clothes line as in claim 9, wherein the releasable locking means comprises a bracket or carriage having a channel extending there through and positioned with the channel extending around the central elongate frame member.

11. A portable clothes line comprising:

a pair of oppositely positioned arms, and a central elongate frame member of continuous length and constant cross sectional shape and size supporting the oppositely positioned arms at each end;

a plurality of lengths of clothesline in parallel alignment extending between the oppositely positioned arms and threaded from a length of pliable line in a manner that provides for a plurality of lines;

a pair of tubular aluminum legs pivotally attached to at least one end of the central elongate frame member, wherein the pair of legs is connected by cross-member secured fixedly so as to ensure the pair of legs extend and retract a stop fixed to the central elongate frame member;

a slidable carriage or bracket positioned and shaped to travel along the central elongate frame member, the carriage comprising an integral collar with an internal bore that is sized and shaped so as to be a free sliding fit when moving along the central frame member and configured to engage with the stop, wherein the stop is positioned between the carriage and the pivot point for the pair of legs; and a link arm pivotally attached to the slidable carriage or bracket and pivotally connected to the pair of legs, such that in use, extension of the legs draws the carriage into releasable locking engagement with the stop, thereby locking the pair of legs in an extended position.

* * * * *